US005882231A

United States Patent [19]

Takano et al.

[11] Patent Number: 5,882,231

[45] Date of Patent: Mar. 16, 1999

[54] SWITCH CONNECTING STRUCTURE

[75] Inventors: Tsunesuke Takano; Kouichi Sinzawa; Yoji Yabata, all of Tokyo, Japan

[73] Assignee: Kabushiki Kaisha T AN T

[21] Appl. No.: 777,346

[22] Filed: Dec. 27, 1996

[30] Foreign Application Priority Data

Oct. 22, 1996 [JP] Japan ..... 8-279609

[51] Int. Cl.[6] ..... H01R 11/00

[52] U.S. Cl. ..... 439/723; 439/949

[58] Field of Search ..... 439/76.2, 723, 439/949

[56] References Cited

U.S. PATENT DOCUMENTS 5,416,972 5/1995 Sugiura et al. ..... 439/76.2

*Primary Examiner*—Khiem Nguyen
*Assistant Examiner*—Eugene G. Byrd
*Attorney, Agent, or Firm*—Nixon & Vanderhye P.C.

[57] ABSTRACT

A switch connecting structure comprising: a switch in which at least two facing terminal plates are formed within recesses formed in a portion of a housing; bus bars having blade terminals rising from an insulated base; and, connection terminals in which are formed a pair of first resilient clamps that are inserted into said housing recesses and resiliently fit onto said terminal plates, and a pair of second resilient clamps that resiliently fit onto the blade terminals of said bus bars.

17 Claims, 9 Drawing Sheets

SWITCH CONNECTING STRUCTURE

BACKGROUND OF THE INVENTION

1. Field of the Invention

The present invention relates to a switch connecting structure in which a switch, such as a push-button switch, is directly connected to a bus bar formed on an insulated base.

2. Description of the Prior Art

In the past, in order to connect a switch with a circuit on an insulated base, the switch and circuit were connected by inserting the female connector of a lead wire, of which one end was soldered to the circuit on the insulated base, onto a lead plate of a switch attached to an attached body such as a panel. In the switch connecting structure of the prior art as described above, the number of work processes was large due to having a process in which the switch is mounted to the attached body, and a process in which the female connector connected with the lead of the switch is soldered to an insulated base by means of a lead wire. This resulted in requiring additional time for assembly as well as contributing to increased labor costs.

SUMMARY OF THE INVENTION

In order to solve the above-mentioned problems, the object of the present invention is to provide a switch connecting structure that is able to shorten work time and lower labor costs by enabling a switch to be directly attached to a bus bar formed on an insulated base.

In order for the switch connecting structure of the present invention to achieve the above-mentioned object, a switch connecting structure is provided including a switch in which at least two facing terminal plates are formed within recesses formed in a portion of a housing; bus bars having blade terminals rising from an insulated base; and, connection terminals in which are formed a pair of first resilient clamps that are inserted into the housing recesses and resiliently fit onto the terminal plates, and a pair of second resilient clamps that resiliently fit onto the blade terminals of the bus bars.

The first resilient clamp and the second resilient clamp are bent so as to be positioned with their backs to each other by means of a coupling in the connection terminal. Receptacles for containing the second resilient clamps are formed in the housing. Moreover, insertion tabs extend from the second resilient clamps, and the insertion tabs are inserted into insertion holes formed in the housing.

The first resilient clamp and the second resilient clamp are formed linearly in the connection terminal, or the first resilient clamp and the second resilient clamp are bent into an offset shape by means of a coupling in the connection terminal the ends of the second resilient clamps are placed on ribs formed on the outside surface of the housing.

DESCRIPTION OF THE PREFERRED EMBODIMENT

The following provides an explanation of the form of one embodiment of the switch connecting structure of the present invention with reference to FIG. 1 through FIG. 4.

Figure 3:
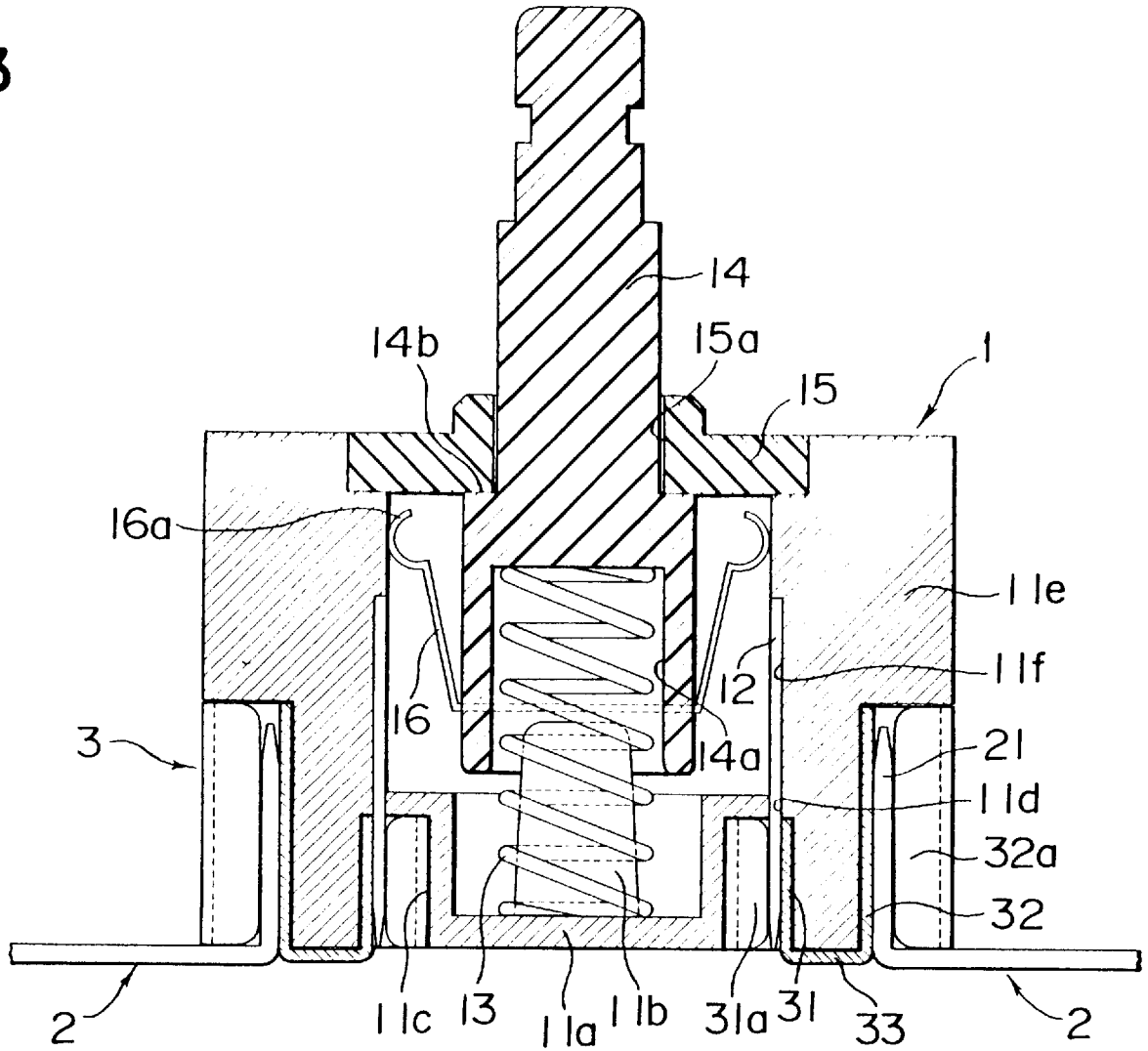
FIG. 3 is a cross-sectional view of the switch in the off state.
Figure 4:
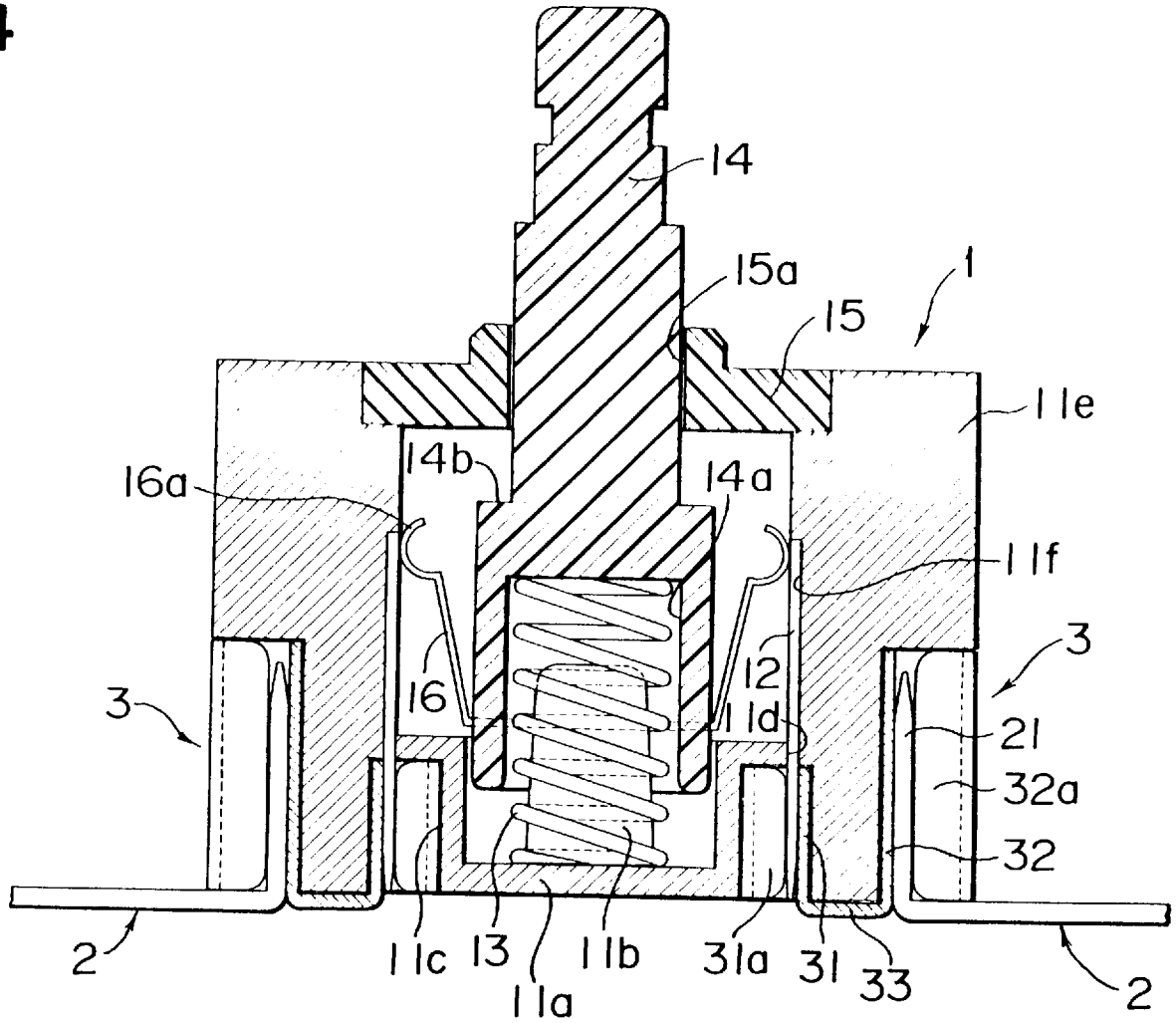
FIG. 4 is a perspective view of the switch in the on state.

In the drawings, reference numeral 1 indicates a switch such as a push-button switch, seesaw switch or slide switch, and as shown in FIGS. 3 and 4, indicates a push-button switch in this embodiment. This push-button switch 1 is used, for example, as a switch for turning on and off the interior lamp unit installed on the roof of an automobile interior.

The following provides a detailed explanation of switch 1. Reference numeral 11 indicates a bottomed housing, projection 11*b* projects toward the inside from the center of bottom 11*a*, and together with mutually facing recesses 11*c* being formed, narrow slot 11*d* is formed in each recess 11*c*. Moreover, ribs 11*e* are formed on the outside of the housing 11 at which the recesses 11*c* are formed.

Reference numeral 12 indicates a pair of terminal plates that are press fit into each groove 11*f* formed in the inside wall of housing 11 from each of the slots 11*d*, the ends of which are exposed to the inside of the recesses 11*c*. Reference numeral 13 indicates a spring of which one end is inserted onto the above-mentioned projection 11*b*. Reference numeral 14 is a pushing lever that pushes on the other end of the spring 13 in hole 14*a*, and protrudes from through hole 15*a* of cover plate 15 fixed on the open end of the above-mentioned housing 11. Reference numeral 16 is a resilient contact plate bent roughly into the shape of the letter "U" that is attached to the above-mentioned pushing lever 14, both ends of which have contacts 16*a* formed into a curved shape.

Next, the following provides an explanation of the operation of the above-mentioned switch 1. In FIG. 3, pushing lever 14 is pushed up by the spring force of spring 13, and is stopped as a result of ledge 14*b* of the pushing lever 14 making contact with cover plate 15. Thus, since contacts 16*a* of resilient contact plate 16 are positioned away from terminal plates 12 in this state, the space between the pair of terminal plates 12 is electrically off.

In the above-mentioned state, when pushing lever 14 is pushed down in opposition to the spring force of spring 13, contact plate 16 lowers as shown in FIG. 4 causing contacts 16a to make contact with terminal plates 12. Consequently, the space between the pair of terminal plates is electrically on. If this type of push-button switch 1 was to be installed, for example, on the chassis of an automobile with the door closed, switch 1 would enter the on state when the door was opened.

Furthermore, although the switch shown in the drawings only enters the on state when pushing lever 14 is pushed, it can be made into a locking push-button switch by incorporating a known locking mechanism. If this type of locking push-button switch 1 was to be used as, for example, a switch for turning on and off the interior lamp unit installed on the roof of an automobile interior, it could be used to turn the interior lamp on and off. Next, the following provides an explanation of a means for installing the above-mentioned switch 1 on, for example, an automobile chassis as for use as a door switch.

Reference numeral 2 indicates blade terminals 21 formed by bending the ends of a pair of bus bars fixed in an insulated state on a chassis (not shown) at a right angle.

Reference numeral 3 indicates a connection terminal that connects the above-mentioned terminal plate 12 in switch 1 and the above-mentioned blade terminal 21, forming a first resilient clamp 31 that engages with terminal plate 12 and a second resilient clamp 32 that engages with the above-mentioned blade terminal 21. A coupling 33 connects this first resilient clamp 31 and second resilient clamp 32.

The above-mentioned first and second resilient clamps 31 and 32 are in the form of eyeglass-shaped terminals 31*a* and 32*a* bent towards the inside into a curved shape on the right and left sides. First resilient clamp 31 is of a size that enables it to enter into recess 11*c* of housing 11 causing terminal plate 12 to be clamped by terminal 31*a*. In addition, blade terminal 21*a* enters inside terminal 32*a* of second resilient clamp 32 and is clamped by said terminal 32*a*.

Figure 1:
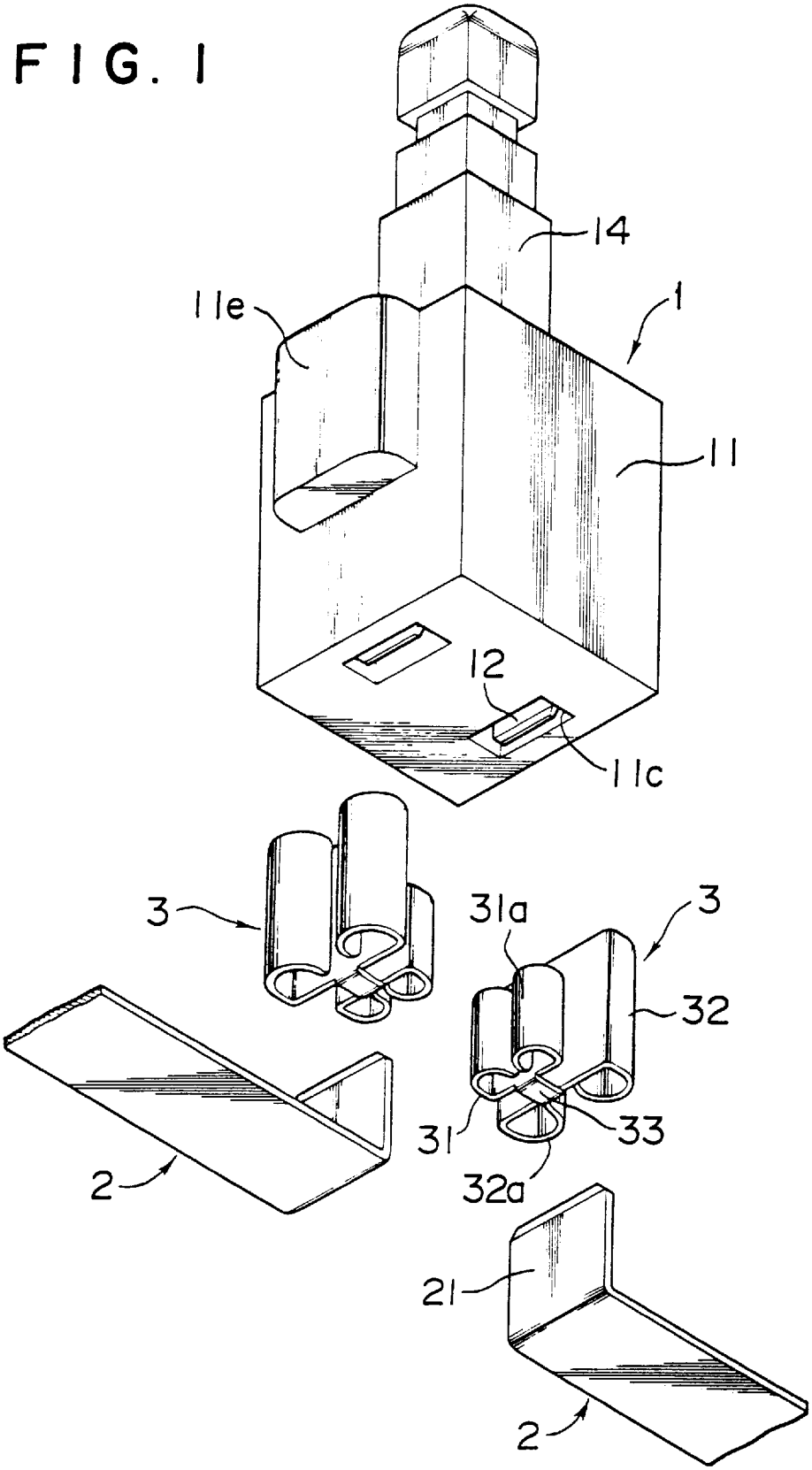
FIG. 1 is an exploded perspective view showing a first embodiment of the switch connecting structure of the present invention.
Figure 2:
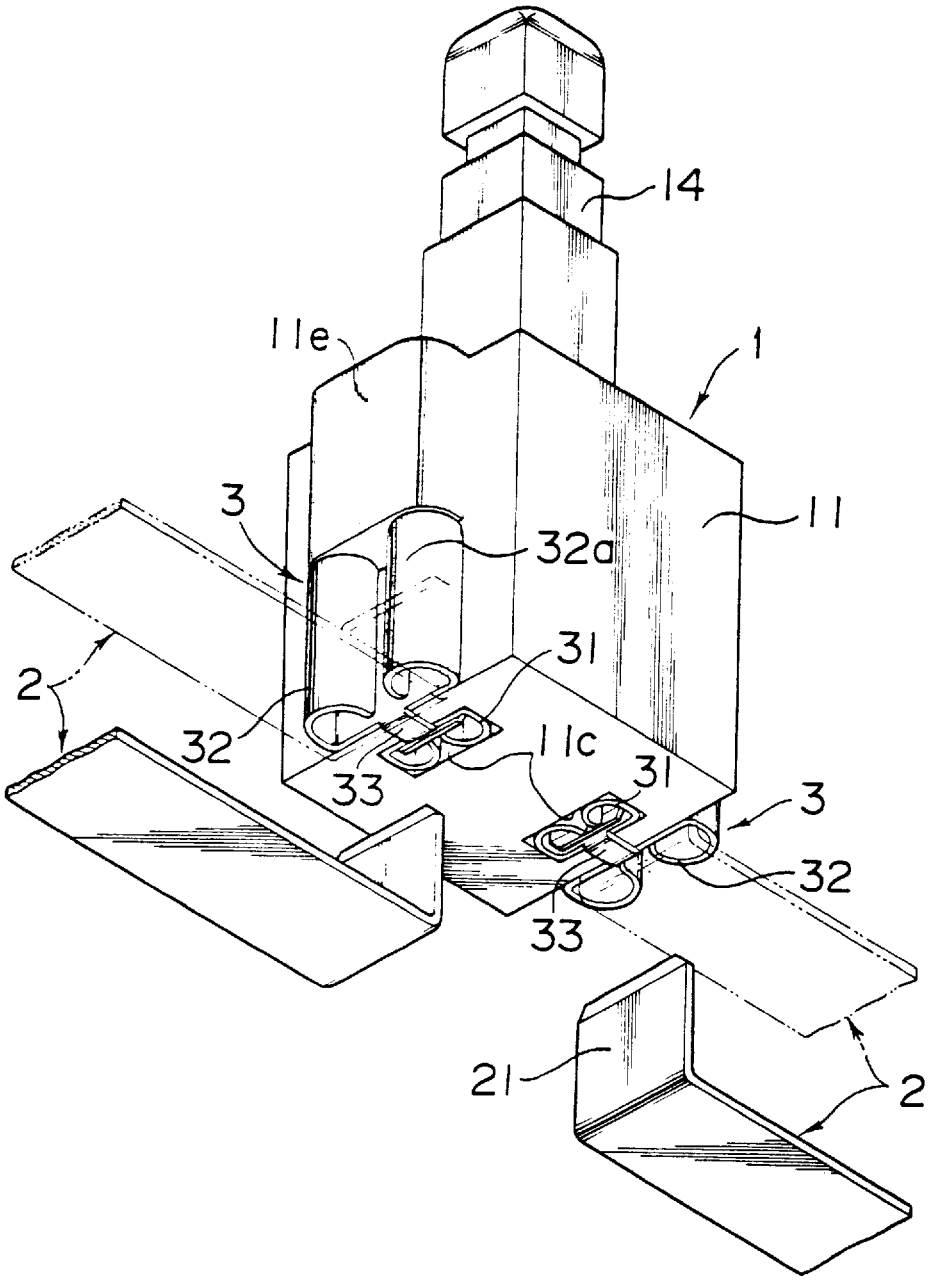
FIG. 2 is a perspective view of the assembled state of the above.

Thus, when terminals 31*a* of the first pair of resilient clamps 31 of a pair of connection terminals 3 are first inserted into recesses 11*c* of housing 11 so that terminals 32*a* are positioned on the outside of housing 11, terminals 31*a* engage with terminal plates 12 and are resiliently clamped in position. In this clamped state, terminals 32*a* are fixed in position by making contact with ribs 11*e* of housing 11 as shown in FIG. 2. Since blade terminals 21 of a pair of bus bars 2 are attached at roughly the same interval as the pair of second resilient clamps 32 in the pair of connection terminals 3, when switch 1 to which connection terminals 3 are fixed is lowered towards blade terminals 21, blade terminals 21 are inserted into terminals 32*a* of each second resilient clamp 32, thus causing switch 1 to be fixed to bus bars 2.

Consequently, when pushing lever 14 in switch 1 is pushed down, the space between the pair of bus bars 2 becomes electrically connected. In addition, when the pushing force on pushing lever 14 is released, the space between the pair of bus bars 2 becomes electrically open.

In the above-mentioned embodiment, although the ends of second resilient clamps 32 are fixed in position by making contact with ribs 11*e* of housing 11, the ends of the switch can be prevented from being exposed by increasing the width in the horizontal direction of housing 11 (to the left and right in FIGS. 3 and 4), forming holes to contain second resilient clamps 32 in the widened portion, and containing second resilient clamps 32 in these holes.

Figure 5:
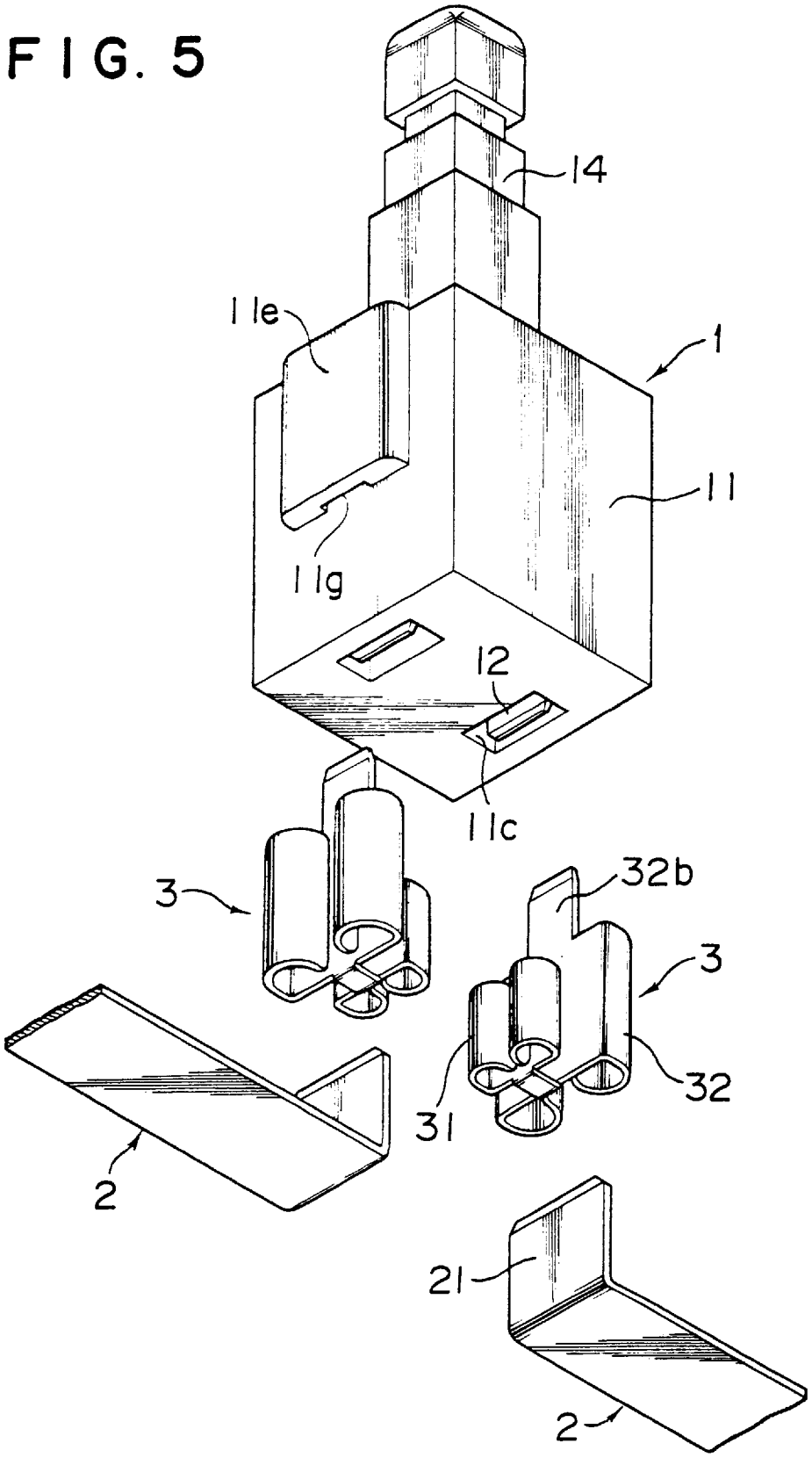
FIG. 5 is an exploded perspective view showing a second embodiment of the present invention.

Furthermore, in the above-mentioned embodiment, although connection terminals 3 are fixed in housing 11 by engaging and clamping terminals 31*a* of first resilient clamps 31 in connection terminals 3 in terminal plates 12, connection terminals 3 can be fixed more reliably in housing 11 than by first resilient clamps 31 by extending insertion tabs 32*b* from the end of terminals 32*a* of second resilient clamps 32 as shown in FIG. 5, and inserting these insertion tabs 32*b* into insertion holes 11*g* formed in ribs 11*e* on housing 11.

Figure 6:
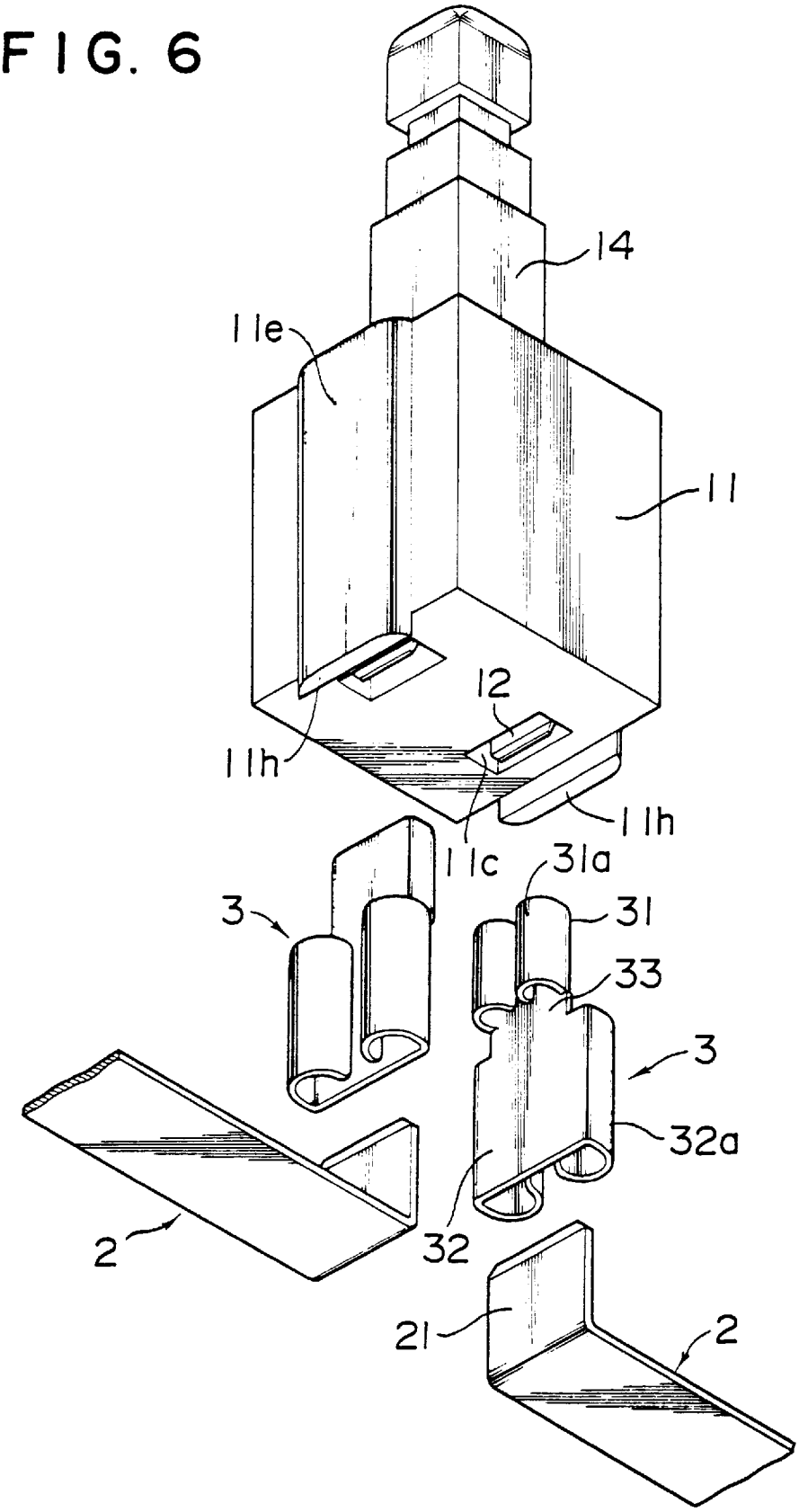
FIG. 6 is an exploded perspective view showing a third embodiment of the present invention.
Figure 7:
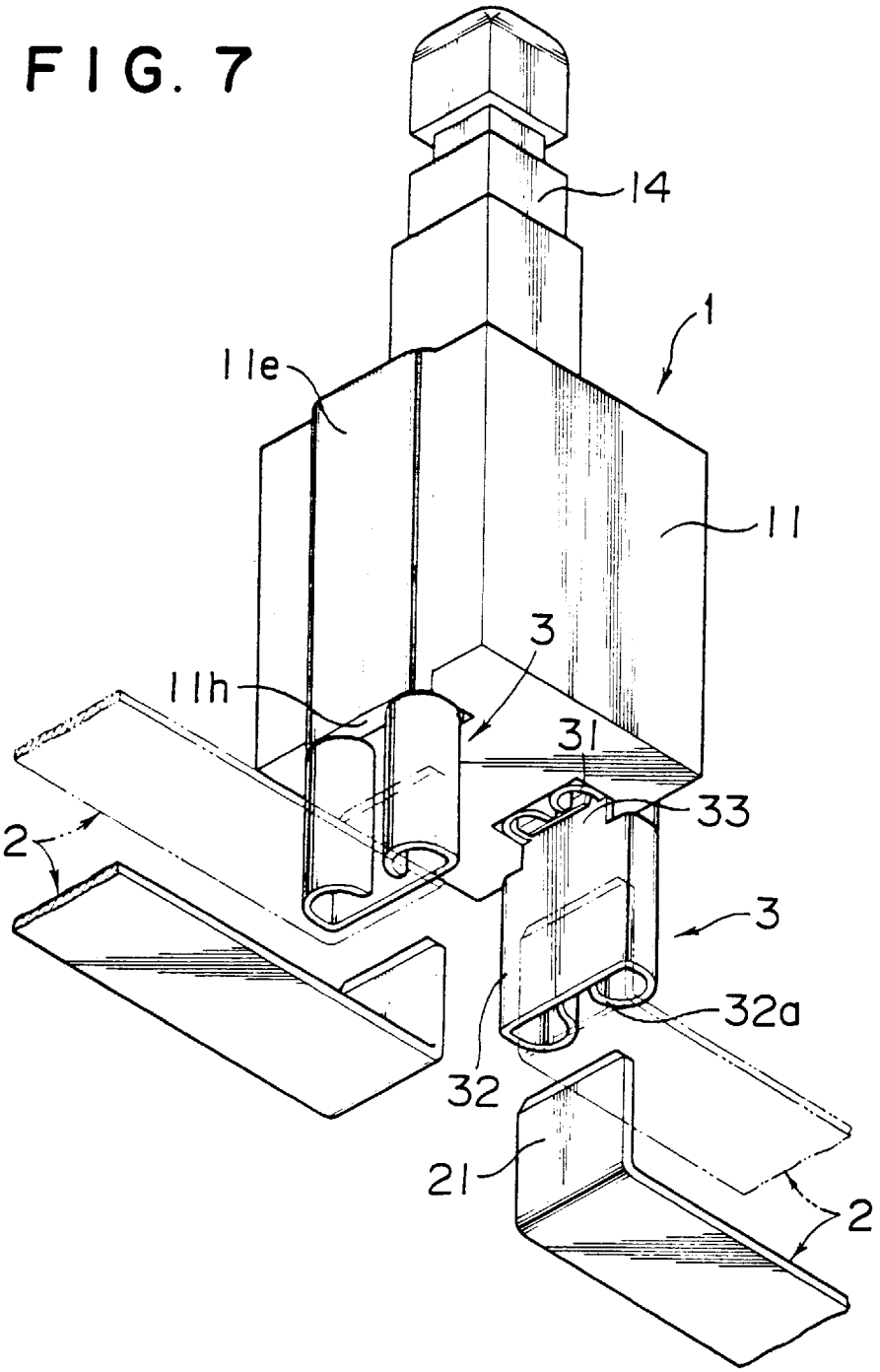
FIG. 7 is an exploded perspective view showing the assembled state of the above.

FIGS. 6 and 7 indicate another embodiment of the present invention. In contrast to the above-mentioned two embodiments having first and second resilient clamps 31 and 32 bent in the same direction with coupling 33 in between, in the present embodiment, first and second resilient clamps 31 and 32 are arranged linearly and mutually rotated 180 degrees with coupling 33 in between. In addition, ribs 11*e* of housing 11 are made to protrude by the length of the above-mentioned coupling 33 forming extensions 11*h*.

Figure 8:
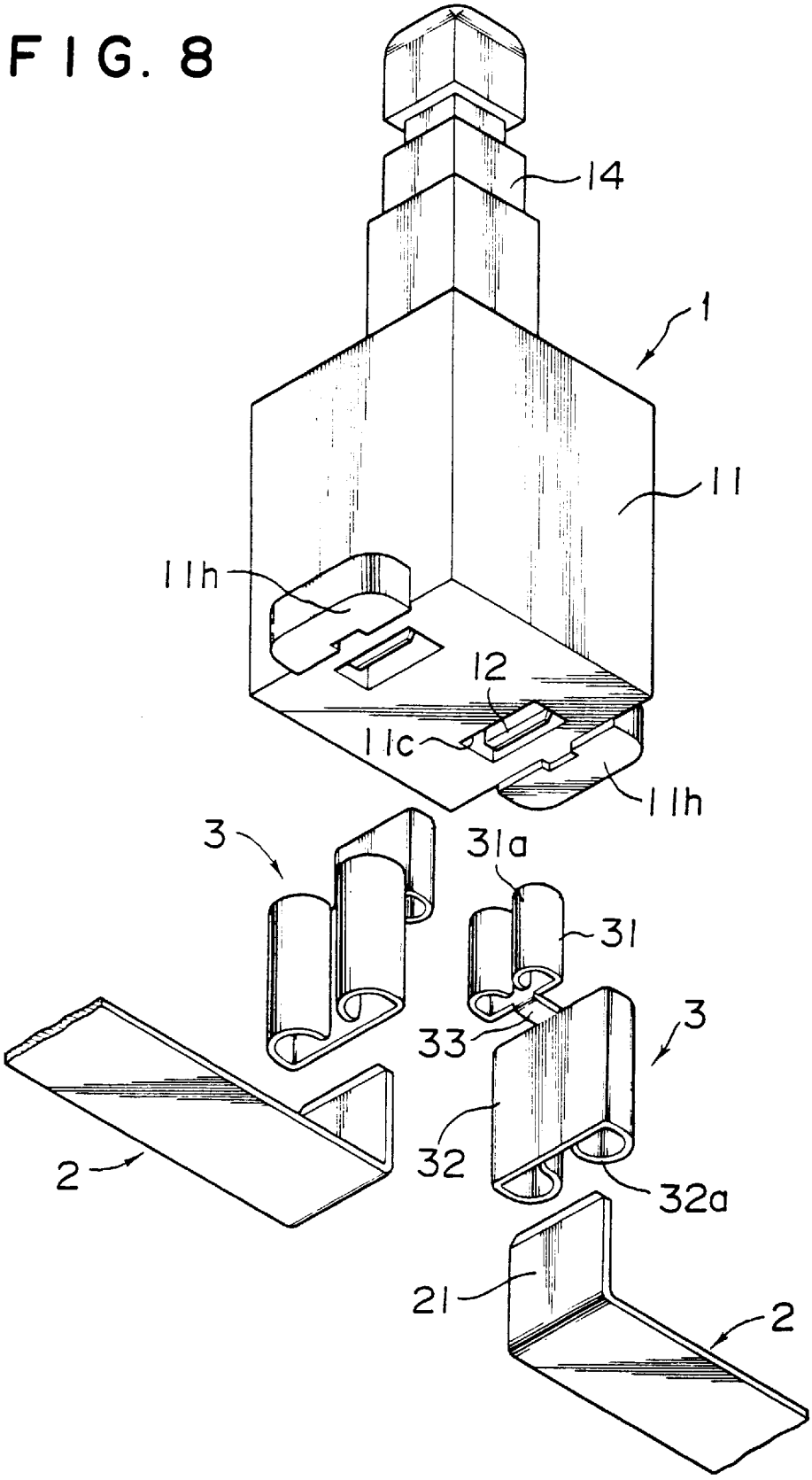
FIG. 8 is an exploded perspective view showing a fourth embodiment of the present invention.
Figure 9:
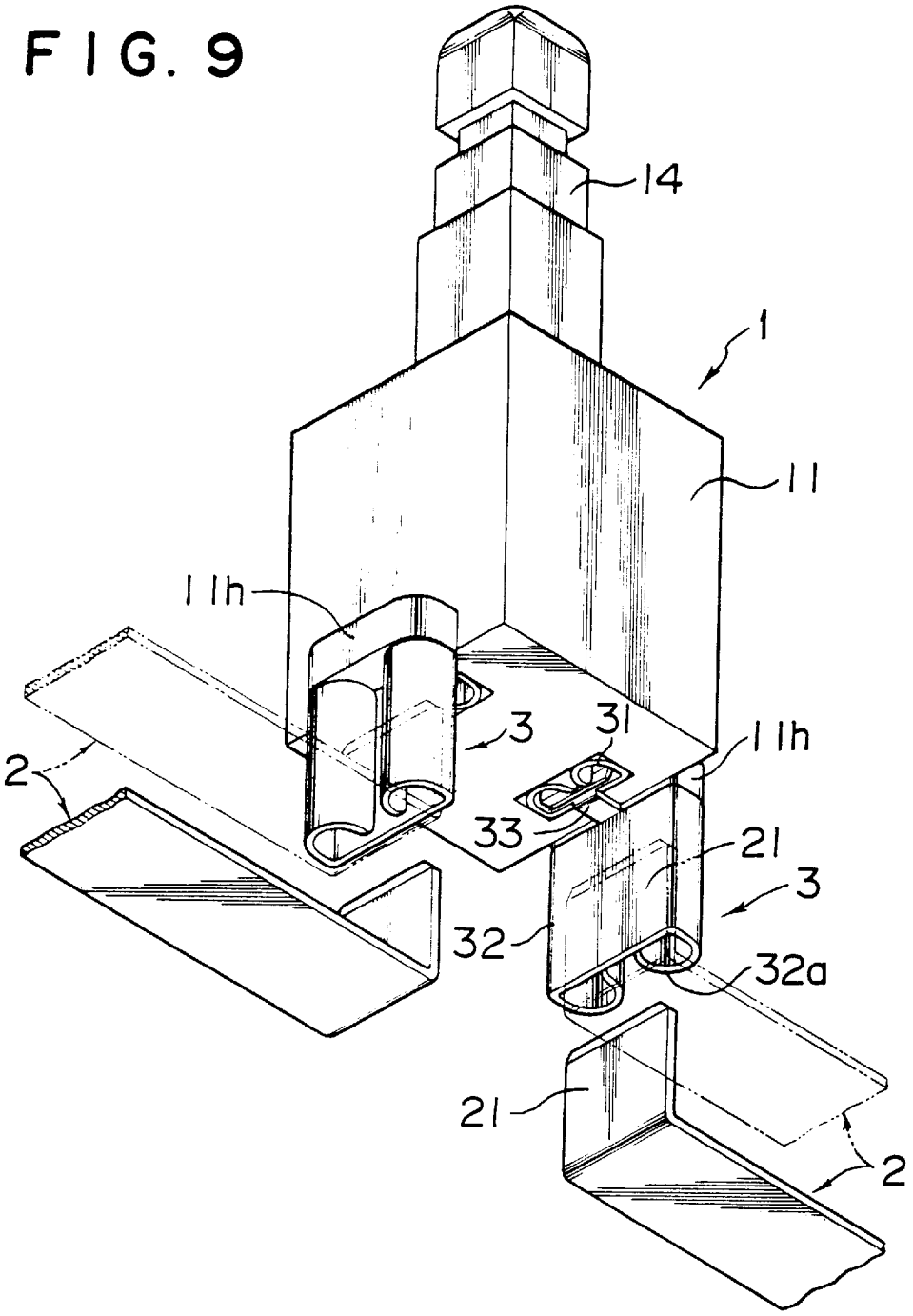
FIG. 9 is an exploded perspective view showing the assembled state of the above.

As a result of being composed in this manner, when first resilient clamps 31 are engaged and clamped in terminal plates 12, since second resilient clamps 32 are in the state of being placed on the above-mentioned extensions 11*h*, they are fixed in a stable state. Consequently, this enables the switch to be used even in locations in which the interval between blade terminals 21 of bus bars 2 and housing 11 is long, or housing 11 and bus bars 2 are in such close proximity that they cannot be attached. FIGS. 8 and 9 indicate another embodiment of the present invention. In contrast to the above-mentioned embodiment shown in FIGS. 6 and 7 having first and second resilient clamps 31 and 32 formed linearly, in the present embodiment, coupling 33 is bent at a right angle causing first resilient clamp 31 and second resilient clamp 32 to be offset from each other. In this case, since couplings 33 are placed on the upper surface of housing 11 and second resilient clamps 32 are placed on extensions 11*h*, they are fixed in position in a more stable state.

Furthermore, regardless of the shape of connection terminals 3 in each of the above-mentioned embodiments, what is important is that two first and second resilient clamps 31 and 32 be formed on one connection terminal 3, so that the ends of terminals 31*a* of first resilient clamps 31 engage and are clamped in terminal plates 12 in housing 11, and terminals 32*a* of second resilient clamps 32 engage and are clamped in the blade terminals of bus bars 2.

As has been described above, the present invention connects a switch, in which at least a pair of terminal plates are formed facing each other within recesses formed in a portion of a housing, to bus bars having blade terminals rising upwards from an insulated base, by means of connection terminals that are inserted into recesses of the above-mentioned housing. First resilient clamps resiliently engage and are clamped in the terminal plates, and second resilient clamps resiliently engage and are clamped in the blade terminals of the above-mentioned bus bars. Connection of the switch and bus bars can thus be performed easily without using a connecting means such as soldering, thus simplifying the work process since the work time required for connecting the two components is shortened and the two components can be disconnected easily.

In addition, by engaging insertion tabs extending from the second resilient clamps with insertion holes of the housing, fixation of the connection terminals to the switch is made more reliable. Moreover, by forming first and second resilient clamps into a linear shape, the interval between the bus bars and switch can be made longer thus enabling variation to be obtained in the manner in which the state is attached.

By placing the ends of the second resilient clamps on ribs formed on the housing, the connection terminals are fixed to the switch in stable manner, thus offering the advantage of preventing the switch from being deformed with respect to the bus bars.

It is claimed:

1. A switch housing for a switch, comprising:

a recess formed in the housing;

a terminal plate disposed in said recess;

a connection terminal having a first resilient clamp secured via a coupling to a second resilient clamp, said first resilient clamp being disposed in said recess in electrical engagement with said terminal plate;

a bus bar electrically engaged with said second resilient clamp; and a structural member engaging said second resilient clamp, said structural member stabilizing said second resilient clamp.

2. A switch housing as set forth in claim 1 wherein said first resilient clamp and said second resilient clamp are bent so as to be positioned with their backs to each other by means of said coupling.

3. A switch housing as set forth in claim 1, wherein said structural member comprises a receptacle containing said second resilient clamp in the housing.

4. A switch housing as set forth in claim 1, further comprising an insertion hole, wherein an insertion tab extends from said second resilient clamp, said insertion tab being inserted into said insertion hole formed in said housing.

5. A switch housing as set forth in claim 2 wherein said first resilient clamp and said second resilient clamp are bent into an offset shape by said coupling.

6. A switch housing as set forth in claim 1, wherein said structural member comprises ribs formed on an outside surface of the housing.

7. A switch housing as set forth in claim 6, wherein said ribs comprise an insertion hole therein, and wherein said second resilient clamp comprises an insertion tab for insertion into said insertion hole.

8. A switch housing as set forth in claim 5, wherein said structural member comprises ribs formed on an outside surface of the housing, said ribs protruding by a length of said coupling.

9. A switch connecting structure formed in a switch housing, the switch connecting structure comprising:

a pair of recesses formed in the housing;

terminal plates disposed in said recesses;

a pair of connection terminals having first resilient clamps secured via a coupling to second resilient clamps, respectively, each of said first resilient clamps being disposed in one of said recesses in electrical engagement with a corresponding one of said terminal plates;

a pair of bus bars each electrically engaged with one of said second resilient clamps; and means for stabilizing said second resilient clamps.

10. A switch connecting structure as set forth in claim 9, wherein each of said first resilient clamps and said second resilient clamps are bent so as to be positioned with their respective backs to each other by means of said coupling.

11. A switch connecting structure as set forth in claim 9, wherein said stabilizing means comprises a receptacle containing said second resilient clamps in the housing.

12. A switch connecting structure as set forth in claim 9, wherein the housing includes insertion holes, and wherein insertion tabs extend from said second resilient clamps, said insertion tabs being inserted into said insertion holes.

13. A switch connecting structure as set forth in claim 9, wherein said first resilient clamps and said second resilient clamps are respectively bent into an offset shape by said coupling.

14. A switch connecting structure as set forth in claim 13, wherein said structural member comprises ribs formed on an outside surface of the housing, said ribs protruding by a length of said coupling.

15. A switch connecting structure as set forth in claim 9, wherein said stabilizing means comprises ribs formed on an outside surface of the housing.

16. A switch connecting structure as set forth in claim 15, wherein said ribs comprise an insertion hole therein, and wherein said second resilient clamps comprise insertion tabs for insertion into said insertion holes.

17. A switch housing for a switch, comprising:

a recess formed in the housing;

a terminal plate disposed in said recess;

a connection terminal having a first resilient clamp secured via a coupling to a second resilient clamp, said first resilient clamp being disposed in said recess in electrical engagement with said terminal plate, said coupling being abutted against the housing to thereby stabilize the connection terminal; and a bus bar electrically engaged with said second resilient clamp.

* * * * *